United States Patent [19]

Drury et al.

[11] Patent Number: 4,787,316

[45] Date of Patent: Nov. 29, 1988

[54] EXPANDABLE, SELF-TAMPING EXPLOSIVE BAG

[75] Inventors: Fred C. Drury; Donald J. Westmaas, both of Wheaton; Philip H. Porter, Pittsfield, all of Ill.

[73] Assignee: Econex, Inc., Wheaton, Ill.

[21] Appl. No.: 649,115

[22] Filed: Sep. 10, 1984

[51] Int. Cl.[4] ..... F42B 3/00

[52] U.S. Cl. ..... 102/323; 102/324; 102/334

[58] Field of Search ..... 102/323, 324, 333

[56] References Cited

U.S. PATENT DOCUMENTS

| | | | |
|---|---|---|---|
| 2,966,855 | 1/1961 | Barco | 102/323 |
| 3,122,096 | 2/1964 | Wick | 102/323 |
| 3,323,455 | 6/1967 | Griffith | 102/323 |
| 3,731,625 | 5/1973 | Slawinski | 102/324 |
| 3,791,297 | 2/1974 | McKee | 102/324 X |
| 3,806,025 | 4/1974 | Marshall | 102/333 X |
| 3,881,417 | 5/1975 | Mesia | 102/324 X |
| 4,492,165 | 1/1985 | Marz | 102/324 X |

*Primary Examiner*—Peter A. Nelson

*Attorney, Agent, or Firm*—Robert F. Van Epps

[57] ABSTRACT

A package for blasting agents including an outer bag of a first diameter formed of a multilayer rupturable paper material and an inner waterproof bag of a second diameter larger than the diameter of the outer bag such that, upon being dropped into a blast hole, the outer bag ruptures allowing the inner bag to expand to the full cross section of the hole without tamping while maintaining the blasting agent in a waterproof condition.

2 Claims, 1 Drawing Sheet

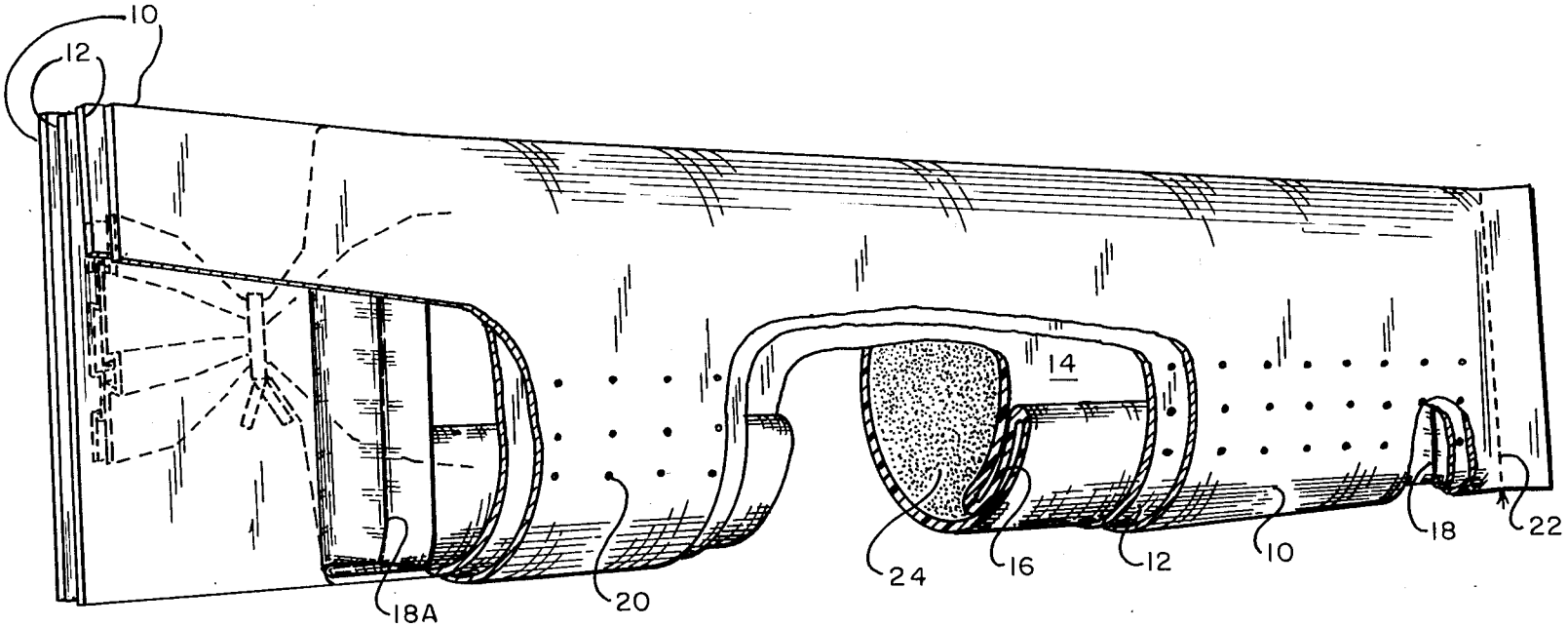
22
18
10
12
14
16
24
20
18A
10
12

EXPANDABLE, SELF-TAMPING EXPLOSIVE BAG

BACKGROUND OF THE INVENTION

1. Field of the Invention

The present invention relates generally to the field of commercial blasting and more particularly to a new and improved package for blasting agents.

2. Description of the Prior Art

In modern commercial blasting operations such as strip mining or quarrying a series of blast holes are drilled in the material to be blasted and a blasting agent such as prilled ammonium nitrate and fuel oil (ANFO) is introduced into the hole. Among the factors which bear upon the efficiency with which such explosives may be used are the percentage volume of the blast hole actually loaded with blasting agent and the presence of water in the blast hole.

The volume energy of the ANFO blasting agent is maximized when the blast hole is substantially completely filled such that the blasting agent is in direct contact with the material to be blasted. Under ideal circumstances the ANFO is preferred to be loaded in bulk directly into the blast hole. If, however, the blast holes contain even small amounts of water it will be readily absorbed by the ANFO. The result is that the water replaces the air sites in the porous prill and reduces both the presence and the uniform distribution of fuel oil in the mix. The end result is to eliminate parially; substanially or totally the potential hot spot locations for adiabatic compression which are essential for the propogation of detonation in modern chemical explosives. To overcome the wet blast hole problem it therefore becomes necessary to load the blasting agent in waterproof packages which in the first instance must be of a small enough diameter to drop easily down the blast hole and in the second instance expandable on reaching the bottom such as to completely fill the blast hole cross-section while maintaining their water tight integrity.

Prior to the present invention various attempts have been made to provide a package for blasting agents which is useful in the wet blast hole environment. U.S. Pat. Nos. 1,543,851 dated June 30, 1925 to Holderer and No. 2,966,855 dated Jan. 3, 1961 to Barco are representative of the prior art. Holderer describes an explosive cartridge formed of an outer paper wrapper enclosing a larger diameter inner woven textile wrapper which may be waterproofed. The ends of the cartridge are tied closed. The outer wrapper of the Holderer cartridge cannot be relied upon to rupture upon impact with the bottom of the blast and therefore must be tamped in order to ensure that the blasting agent expands to fill the full cross-section. A second problem arises due to the high water pressures which may be encountered (e.g. approximately 20 psi at 40 feet). The tied closure of Holderer cannot reliably provide water tight integrity under such water pressure for a sufficient time period. Barco addresses the problem of package expansion upon impact but requires a positive retaining arrangement which must be released prior to dropping the package into the bast hole. Again, the tied closure has been found to be less than fully effective as a water-tight seal.

OBJECTIVES AND SUMMARY OF THE INVENTION

From the preceding discussion it will be understood that among the various objectives of the present invention are included the following:

the provision of a new and improved package for blasting agents which will reliably expand to fill the cross-section of a blast hole while retaining a water-tight integrity;

the provision of a package of the above described character which does not require any positive closure means to maintain the package configuration prior to use;

the provision of a package of the above described character which is self-tamping.

These and other objectives of the invention are efficiently achieved by providing an outer bag of a first diameter formed of a multilayer rupturable paper material and an inner waterproof bag of a second diameter larger than the diameter of the outer bag. The ends of the inner bag are heat sealed to provide a water-tight closure.

The foregoing as well as other objects, features and advantages of the present invention will become more readily understood from the following detailed description taken in conjunction with the appended drawings.

BRIEF DESCRIPTION OF THE DRAWINGS

The single drawing is an elevation view with portions cut away, of a blasting agent package of the applicants' invention.

DESCRIPTION OF THE PREFERRED EMBODIMENT

With reference now to the drawing there is shown in elevation a blasting agent package in accordance with the principles of the present invention. An outer bag is formed of first and second layers of paper 10 and 12. The type of paper which has been found by the applicants to be most useful is an extensible shipping sack kraft paper such as Stresskraft which is a trademarked product of St. Regis Paper Co. of New York, N.Y. In practice, multiple layers for the paper outer bag have been found superior to a single layer of heavier paper in that the former construction is better able to withstand rough handling during filling, field storage and use. It is preferred but not essential to the practice of the invention that the outermost layer be treated for wet strength. The number of layers in the outer bag will depend upon the size of the package and weight of blasting agent to be accommodated. By way of example, for a fifty pound charge, a two layer construction of one sixty pound and one seventy pound paper are sufficient. For a sixty pound charge three layers of sixty pound paper are used.

The inner bag 14 is formed of a tube of a flexible waterproof material such as polyethylene. Since the maintenance of water-tight integrity of the inner bag is critical to the use of blasting agents such as ANFO in a wet blast hole the applicants selected a ten mil thickness of polyethylene with an additive of between five and eight precent ethyl-vinyl-acetate to reduce the occurrance of stretch tearing. The inner bag is longitudinally folded to thereby provide an expansion pleat 16. In actual practice the outer bag will have a diameter of approximately two inches less than that of the blast hole in which it is intended to be used. The inner bag would then be substantially the same diameter as that of the blast hole.

The longitudinally folded inner bag 14 is closed by means of a heat seal 18 at a selected distance from one end and then inserted in the outer paper bag. The outer bag is provided with a plurality of longitudinal perforation lines 20 such as one-eighth inch pins on one inch centers. The perforation assure that upon impact with the bottom of the blast hole the outer paper bag will reliably rupture along the predetermined line. In assembling the inner and outer bags 14 and 10-12 respectively the longitudinal fold 16 in the inner bag 14 is aligned adjacent to the perforations 20 in the outer bag 10-12. The inner and outer bags are then stitched together outside the heat seal 18 of the inner bag 14 as at 22 to maintain that alignment.

Once the inner bag 14 is filled with blasting agent 24 through the open end it is closed by means of a second heat seal 18A. The sealed inner bag 14 is then folded down into the outer bag 10-12 which is then closed by means of a Tipper Tie which is a trademarked product of Tipper Tie, Inc. of Rosemont, Ill. The tie closure thus does not directly contact the inner bag 14 and thus does not interfere with the maintenance of the watertight integrity thereof. Additionally the excess portion of the outer bag 10-12 provides a convenient handle for the user during loading operations.

With the foregoing construction the applicants have found that when a package of blasting agent is dropped a distance of twenty feet or more, upon impact the blasting agent expands radially against the expansion fold in the inner bag rupturing the outer bag along the perforation line. The inner bag expands to fill the blast hole cross section substantially completely while maintaining its water tight integrity. As successive packages are dropped into the blast hole, compaction or slugging of the explosive occurs which eliminates any requirement for tamping as with the prior art packages.

In commercial mining and quarrying operations the distance between adjacent blast holes is proportional to the weight of blasting agent which can be placed per lineal foot of each hole. Assuming a ten inch diameter dry blast hole permitting the use of bulk ANFO, about twenty mine pounds of explosive per foot of blast hole can be achieved. Using the package of the present invention the same blast hole may be loaded with thirty seven pounds per foot due to the self tamping or slugging effect. The end result is that for the same explosive effect blast holes may be placed farther apart thus improving efficiency of operations.

From the foregoing discussion it will be understood that the applicants have provided a new and improved expandable self-tamping explosive package whereby the objectives set forth hereinabove are efficiently met. Since certain changes in the above-described construction will occur to those skilled in the art without departure from the scope of the invention it is intended that all matter contained in the description or shown in the appended drawing shall be interpreted as illustrative and not in a limiting sense.

Having described what is new and novel and desired to secure by Letters Patent, what is claimed is:

1. An expandable self-tamping bag for blasting agents containing ANFO comprising an outer bag of a first diameter formed of a plurality of layers of a rupturable paper material and provided with a plurality of longitudinal perforation lines;

an inner waterproof bag of a second diameter larger than the diameter of said outer bag, formed of a heat-sealable material having a longitudinal fold therein, disposed within said outer bag with said longitudinal fold in substantial alignment with said perforation lines in said outer bag, adapted to receive a quantity of blasting agent and when filled with blasting agent, is heat sealed at each end thereof;

whereby when said filled bag is dropped into a blast hole, upon impact said outer bag ruptures longitudinally along said perforation lines and said inner bag expands outwardly at said longitudinal fold to substantially fill the cross-section of said blast hole.

2. A bag as defined in claim 1 wherein said inner bag is formed of polyethylene having between five and eight percent ethyl-vinly-acetate additive.

* * * * *